US010213915B1

(12) United States Patent
DeMarco

(10) Patent No.: US 10,213,915 B1
(45) Date of Patent: Feb. 26, 2019

(54) TOOL SHELF ASSEMBLY

(71) Applicant: Vincent DeMarco, Bayside, NY (US)

(72) Inventor: Vincent DeMarco, Bayside, NY (US)

( * ) Notice: Subject to any disclaimer, the term of this patent is extended or adjusted under 35 U.S.C. 154(b) by 0 days.

(21) Appl. No.: 15/655,758

(22) Filed: Jul. 20, 2017

(51) Int. Cl.
*B25H 3/04* (2006.01)
*B66F 13/00* (2006.01)
*B66F 11/04* (2006.01)

(52) U.S. Cl.
CPC ..... *B25H 3/04* (2013.01); *B66F 13/00* (2013.01); *B66F 11/042* (2013.01)

(58) Field of Classification Search
CPC .. B66F 13/00; B65H 3/04; B65H 3/06; E06C 7/14; A47B 96/07; A47B 96/06; A47B 96/063; D06F 57/12; A47F 5/08; A47F 5/0025; A47F 5/01; A47F 5/13; A47F 5/0006; A47F 7/0028; A47F 7/0021; A47F 7/148; A47F 7/0078
USPC ... 211/119.009, 119.004, 70.6, 87.01, 85.13, 211/66, 65, 193, 88.01, 90.01, 113; 248/201, 214, 215, 228.1, 317, 339, 340
See application file for complete search history.

(56) References Cited

U.S. PATENT DOCUMENTS

| | | | |
|---|---|---|---|
| 1,614,342 | A | 1/1927 | Bleckley |
| 1,987,723 | A | 1/1935 | Thomasma |
| 2,805,777 | A | 9/1957 | Larson |
| 3,269,550 | A | 8/1966 | William |
| D260,830 | S | 9/1981 | Trouba |
| 4,446,972 | A | 5/1984 | Sussman |
| 4,480,810 | A | 6/1984 | Hall |
| 4,667,822 | A | 5/1987 | Coopmans |
| 5,158,023 | A | 10/1992 | Allen |
| D386,639 | S | 11/1997 | Everrett |
| 5,740,883 | A | 4/1998 | Trank |
| 5,743,416 | A | 4/1998 | Yemini |
| 5,884,784 | A | 3/1999 | Betts |
| 5,921,407 | A | 7/1999 | Kabanek |
| 6,095,057 | A | 1/2000 | Corban |
| 6,484,892 | B1 | 11/2002 | Gooner |
| 6,688,570 | B1 | 2/2004 | Mundt |
| 6,837,383 | B1 | 1/2005 | McElhaney |
| D542,034 | S | 8/2007 | Romano |
| D602,724 | S | 10/2009 | Liu |
| 8,038,110 | B2 | 10/2011 | Talbott |
| 8,517,320 | B1 | 8/2013 | Nicely |
| 9,056,756 | B1 | 6/2015 | De Marco |
| 2005/0067361 | A1 | 3/2005 | Waymire |
| 2005/0258002 | A1 | 11/2005 | Sabo |
| 2006/0102569 | A1 | 5/2006 | Laga |
| 2008/0000854 | A1 | 1/2008 | Rief |

(Continued)

*Primary Examiner* — Patrick D Hawn
(74) *Attorney, Agent, or Firm* — Grant Attorneys at Law PLLC; Kristin A. Grant

(57) ABSTRACT

An improved tool shelf assembly allows a user to store and organize tools while working on a scissor lift. The assembly includes a panel having a front surface and a back surface. A flange is coupled to the panel. The flange and the back surface form a channel configured to receive a handrail of a scissor lift to support the panel on the scissor lift. A lower shelf has a lower end, an upper end and a peripheral wall extending between the upper and lower ends. Each of the lower end, the upper end and the peripheral wall define an interior space of the lower shelf. The lower shelf is attached to and extends outwardly from the front surface. A plurality of openings is positioned in the lower shelf. Each of the openings provides access into the interior space wherein each of the openings is configured to receive a tool therein.

10 Claims, 6 Drawing Sheets

(56) References Cited

U.S. PATENT DOCUMENTS

| | | | |
|---|---|---|---|
| 2008/0251476 | A1 | 10/2008 | Shiao |
| 2012/0055839 | A1 | 8/2012 | Moore |

TOOL SHELF ASSEMBLY

BACKGROUND

Field of the Invention

The disclosure relates to tool storage devices and more particularly to an improved tool storage device for allowing a user to organize and store tools while working on a scissor lift.

SUMMARY OF THE INVENTION

An embodiment of the invention meets the needs presented above by generally comprising a panel having a front surface and a back surface. A flange is coupled to the panel. The flange and the back surface form a channel configured to receive a handrail of a scissor lift to support the panel on the scissor lift. A lower shelf has a lower end, an upper end and a peripheral wall extending between the upper and lower ends. Each of the lower end, the upper end and the peripheral wall define an interior space of the lower shelf. The lower shelf is attached to and extends outwardly from the front surface. A plurality of openings is positioned in the lower shelf. Each of the openings provides access into the interior space wherein each of the openings is configured to receive a tool therein.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DETAILED DESCRIPTION

Figure 1:
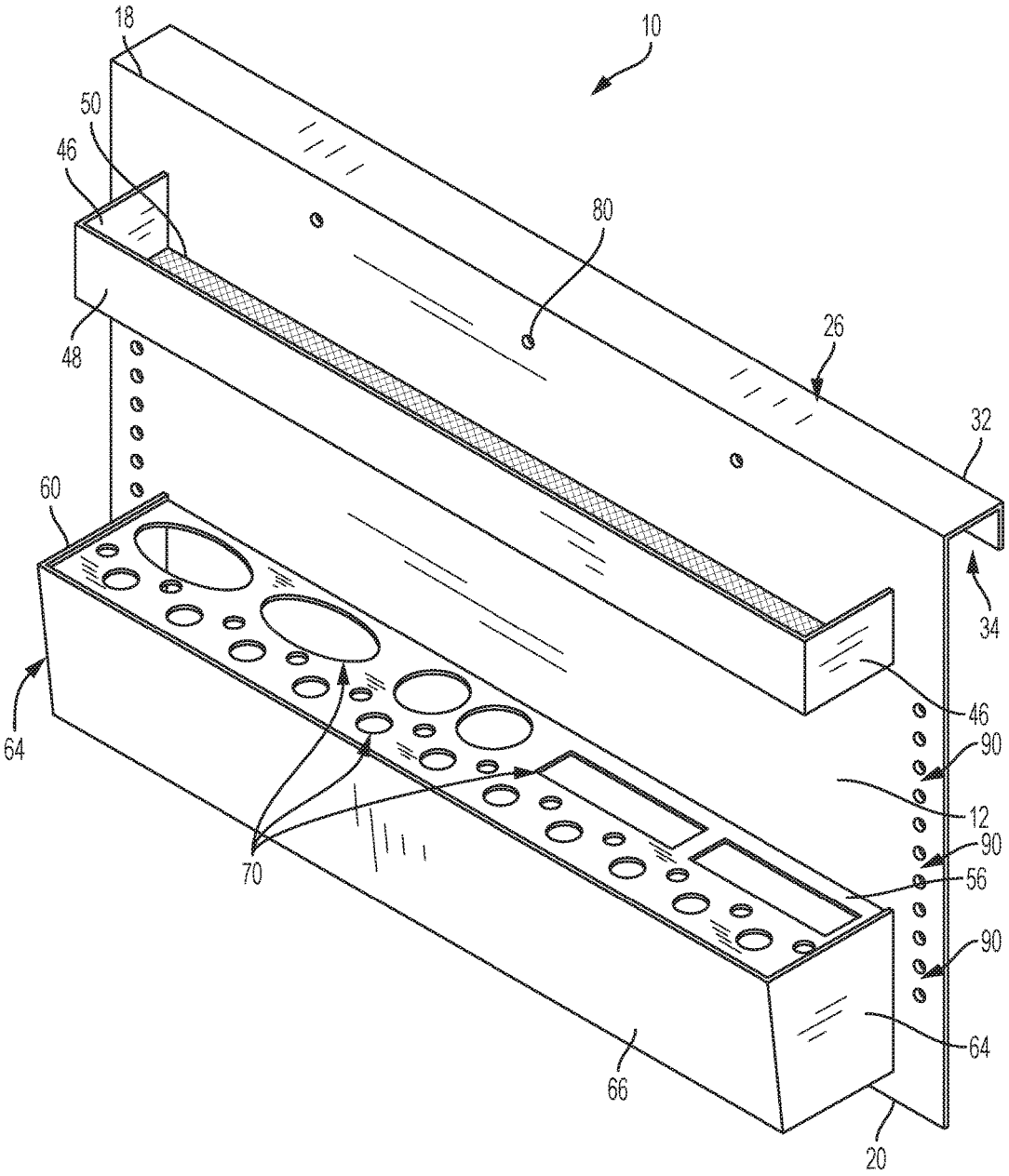
FIG. 1 is a perspective view of a tool shelf assembly according to an embodiment of the present invention.

With reference now to the drawings, an improved tool storage device embodying the principles and concepts of an embodiment of the disclosure and generally designated by the reference numeral 10 will be described.

Figure 2:
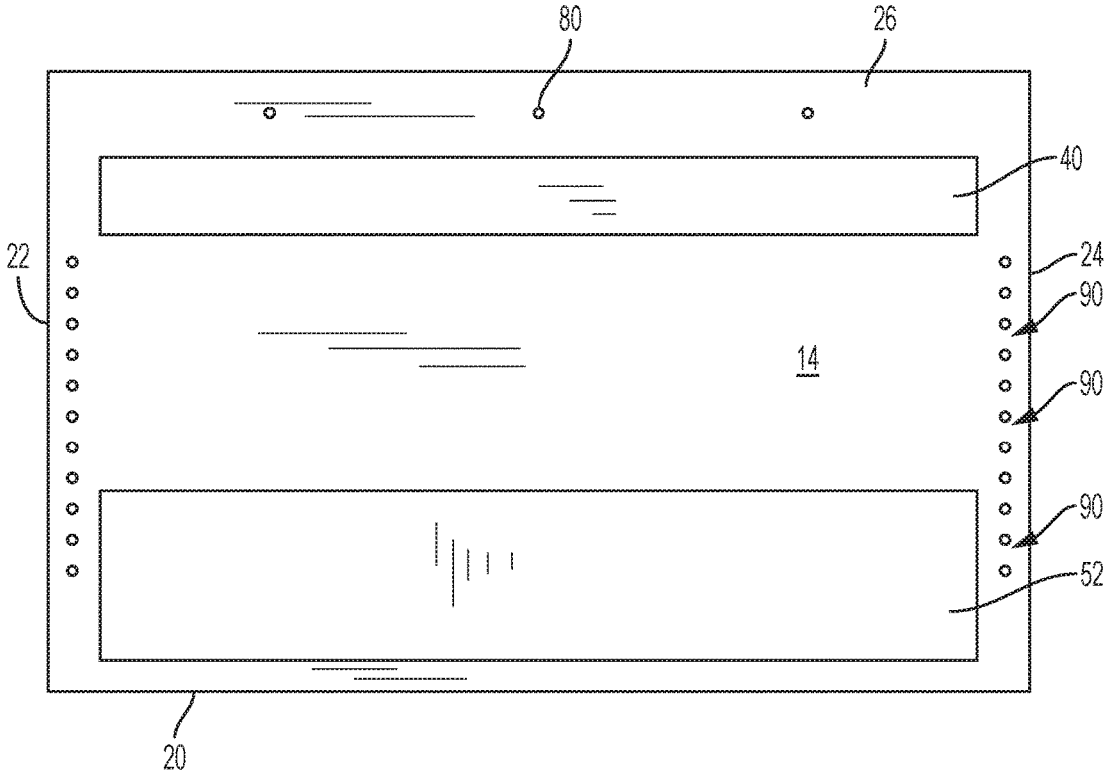
FIG. 2 is a front view of an embodiment of the present invention.
Figure 3:
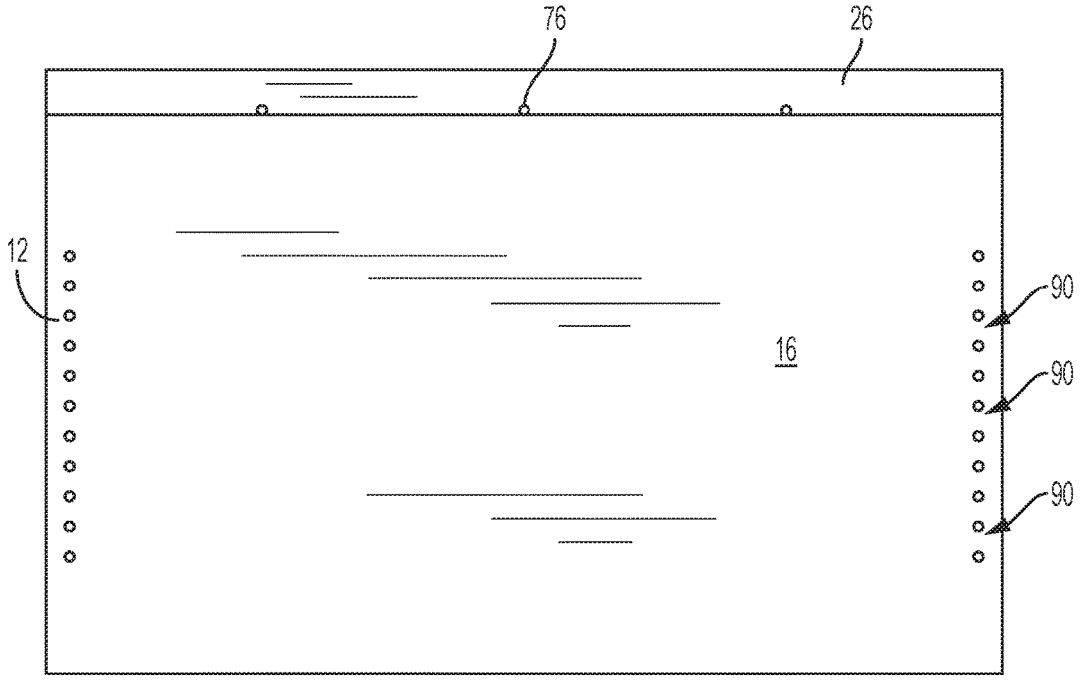
FIG. 3 is a back view of an embodiment of the present invention.
Figure 4:
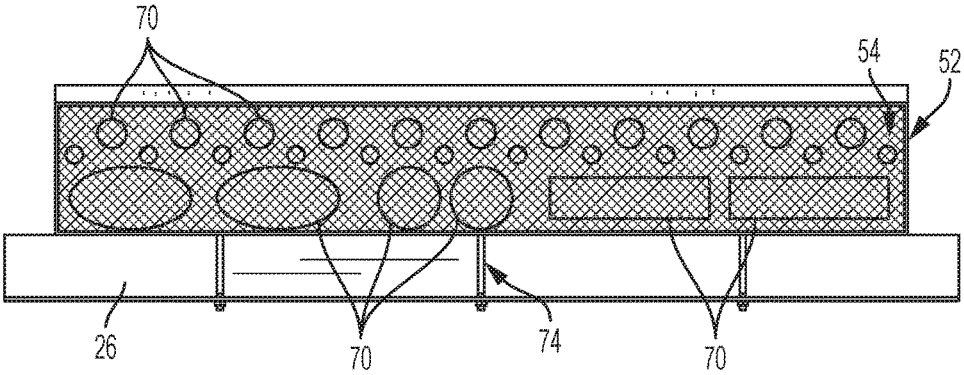
FIG. 4 is a bottom view of an embodiment of the present invention.
Figure 5:
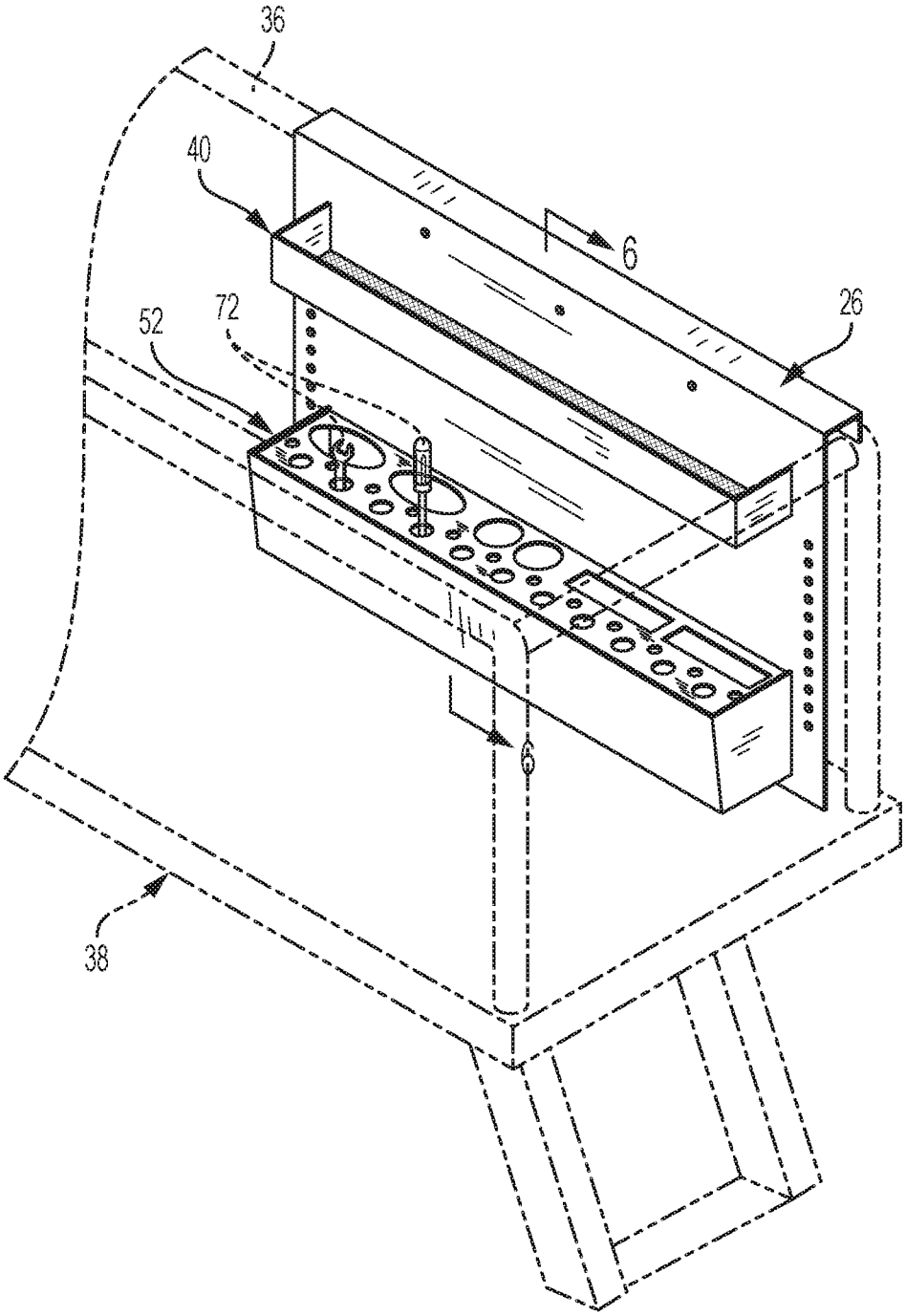
FIG. 5 is an in-use perspective view of an embodiment of the present invention.
Figure 6:
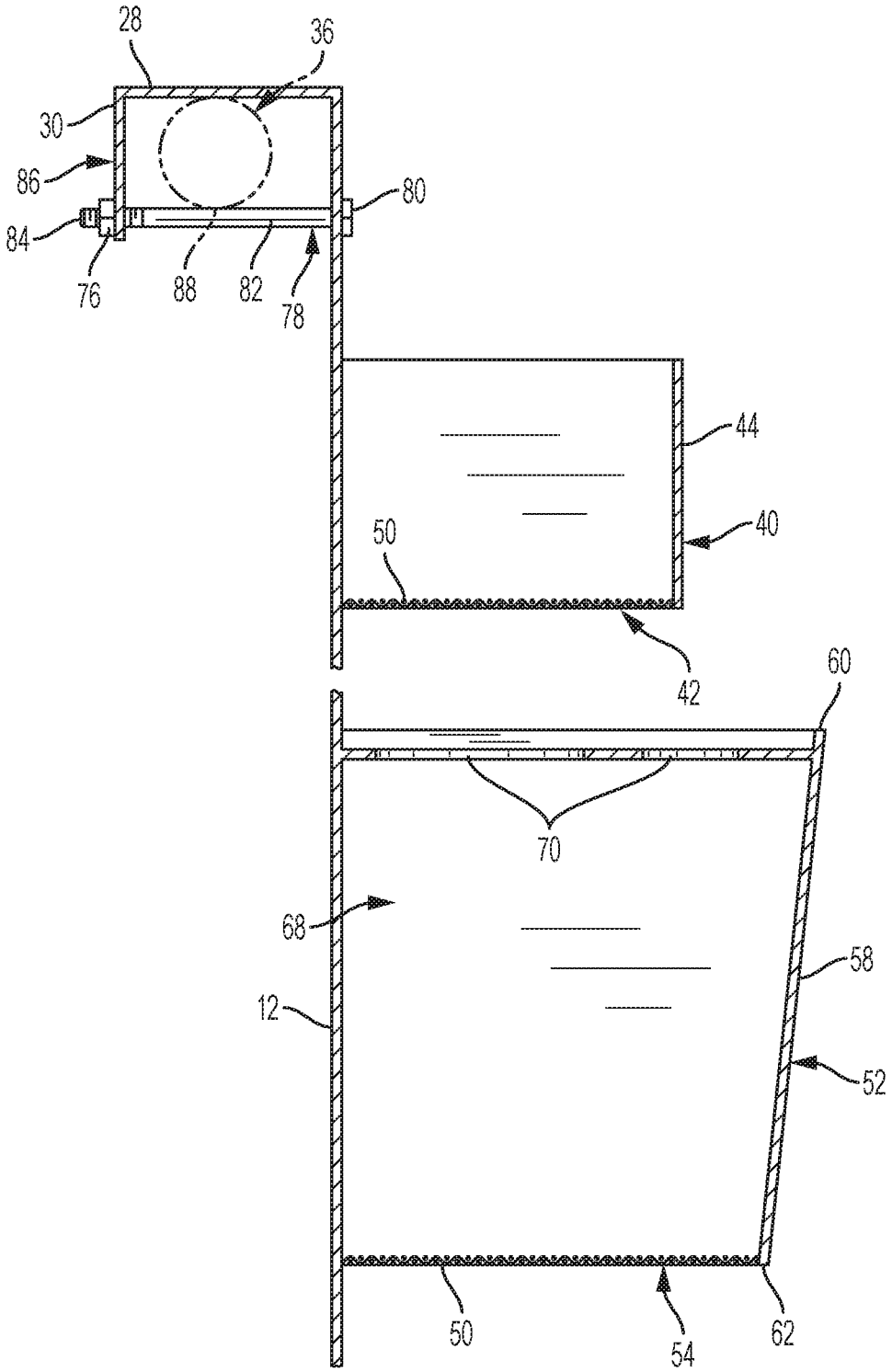
FIG. 6 is a cross-sectional view of an embodiment of the present invention taken along line 6-6 of FIG. 5.

As illustrated in FIGS. 1, 2, and 3 the tool shelf assembly 10 generally comprises a panel 12 having a front surface 14, a back surface 16, a top edge 18, a bottom edge 20, a first lateral edge 22 and a second lateral edge 24. A flange 26 is coupled to the panel 12. The flange 26 includes a first section 28 attached to a second section 30. The first section 28 is coupled to and extends outwardly of the top edge 18 away from the front surface 14. The second section 30 extends downwardly from an outer edge 32 of the first section 28. The first section 28 may be positioned transversely relative to the panel 12. The second section 30 may be positioned parallel with respect to the panel 12. The second section 30 is spaced from the back surface 16 wherein the flange 26 and the back surface 16 form a channel 34. The channel 34 is configured to receive a handrail 36 of a scissor lift 38 to support the panel 12 on the scissor lift 38.

An upper shelf 40 is attached to and extends outwardly from the front surface 14 of the panel 12. The upper shelf 40 has a bottom 42 and a perimeter wall 44. The perimeter wall 44 is attached to and extends upwardly from the bottom 42. The perimeter wall 44 includes a pair of side walls 46 and a front wall 48. The front wall 48 of the upper shelf 40 is attached to and extends between the side walls 46 of the upper shelf 40. The bottom 42 may extend a full length between the first 22 and second 24 lateral edges. The upper shelf 40 is positioned horizontally with respect to the panel 12. The bottom 42 may be constructed from a mesh material 50, such as wired mesh or the like. The upper shelf 40 may be used to store nuts, bolts and like materials. Thus, it should be understood that openings in the mesh material 50 are small enough to retain the materials on the bottom 42 of the upper shelf 40.

A lower shelf 52 is attached to and extends outwardly from the front surface 14 of the panel 12. The lower shelf 52 has a lower end 54, an upper end 56 and a peripheral wall 58 attached to and extending between the upper 56 and lower 54 ends. The peripheral wall 58 includes an uppermost edge 60, a lowermost edge 62, a pair of side walls 64 and a front wall 66. The front wall 66 of the lower shelf 52 is coupled to and extends between the side walls 64 of the lower shelf 52. The uppermost edge 60 may extend above the upper end 56. Each of the lower end 54, the upper end 56 and the peripheral wall 58 defines an interior space 68 of the lower shelf 52. The lower end 54 does not extend the full length between the first 22 and second 24 lateral edges of the panel 12. Preferably, the first 22 and second 24 lateral edges of the panel are equidistant from the lower end 54, at a distance of 1 inch to 4 inches. The lower shelf 52 is positioned horizontally with respect to the panel 12. The lower end 54 may be constructed from a mesh material 50, such as wired mesh or the like. The front wall 66 of the lower shelf 52 may extend outwardly from the front surface 14 a greater distance than the front wall 48 of the upper shelf 52 extends outwardly from the front surface 14. In addition, the front wall 66 of the lower shelf 52 may slant outwardly from the panel 12 such that a distance between the uppermost edge 60 and the front surface 14 of the panel 12 is greater than a distance between the lowermost edge 62 and the front surface 14 of the panel 12. The bottom edge 20 of the panel 12 may extend downwardly below the lower end 54 of the lower shelf 52.

A plurality of openings 70 is positioned in the lower shelf 52. The openings 70 may extend into the upper end 56 of the lower shelf 52. Each of the openings 70 provides access into the interior space 68 of the lower shelf 52 wherein each of the openings 70 is configured to receive a tool 72 therein. The openings 70 may include annular-shaped openings, rectangular-shaped openings, or the like.

A plurality of fasteners 74 selectively engaging the flange 26 and the panel 12 wherein the plurality of fasteners 74 are configured to releasably retain the handrail 36 within the channel 34. The plurality of fasteners 74 each include a nut 76 and a bolt 78. The bolt 78 is conventional and has a head 80 coupled to a shaft 82. The head 80 is extendable through the panel 12 wherein the head 80 is configured to abut the front surface 14 of the panel 12. The shaft 82 is extendable through the second section 30 of the flange 26. The nut 76 is positionable on a distal end 84 of the shaft 82 with respect to the head 80 and is configured to abut an outer surface 86 of the second section 30. The shaft 82 is configured to extend below and abut a bottom surface 88 of the handrail 36.

A plurality of couplers 90 arranged vertically, said plurality of couplers proximate to and parallel to the first 22 and second 24 lateral edges of the panel 12 for selectively engaging the panel 12 and the handrail 36 wherein the plurality of couplers are configured to releasably retain the handrail 36. The couplers comprising of a nut and a bolt, hook and loop fasteners, tie fasteners, or other coupling means generally known in the art.

Each of the panel 12, the upper shelf 40, the lower shelf 52 and the flange 26 may be constructed from plastic, metal or the like. The panel 12 may have a height between approximately 50.0 centimeters and 80.0 centimeters and a length between approximately 75.0 centimeters and 155.0 centimeters. The upper shelf 40 may have a depth between approximately 6.5 centimeters and 12.0 centimeters, while the lower shelf 52 may have a depth between approximately 12.5 centimeters and 18.5 centimeters.

In use, as stated above and shown in the Figures, tools 72 are positioned in the openings 70 of the lower shelf 72, while nuts, bolts and the like are positioned in the upper shelf 40. The flange 26 is attached to the handrail 36 of the scissor lift 38 so that the channel 34 receives the handrail 36 and supports the panel 12 on the scissor lift 38. The plurality of fasteners 74 extended through each of the panel 12 and the flange 26 to releasably retain the handrail 36 within the channel 34. The plurality of couplers 90 engage the panel 12 and the handrail 36 securing the tool storage device 10 to the scissor lift to prevent movement of the tool storage device 10 in the event of windy conditions. Thus, the assembly 10 provides a user with a location to store tools 72 and other materials while working on a scissor lift 38. In this manner, the tools 72 and materials are readily accessible to the user and create less of a likelihood that the user will drop, break or lose the tools 72 and materials. After use, the assembly 10 can be removed from the scissor lift 38 by disengaging the fastener 74 from the flange 26.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the element.

What is claimed is:

1. A tool shelf assembly comprising:

a panel having a front surface, a back surface, a first lateral edge, and a second lateral edge;

a flange coupled to said panel, said flange and said back surface forming a channel wherein said channel is configured to receive a handrail of a scissor lift to support said panel on the scissor lift, said flange including a first section attached to a second section, said first section being coupled to and extending outwardly of a top edge of said panel away from said front surface, said second section extending downwardly from an outer edge of said first section;

a plurality of fasteners selectively engaging said flange and said panel wherein said plurality of fasteners are configured to releasably retain the handrail within said channel, said plurality of fasteners each including a nut and a bolt, said bolt having a head coupled to a shaft, said head being extendable through said panel wherein said head is configured to abut said front surface of said panel, said shaft being extendable through said second section of said flange, said nut being positionable on a distal end of said shaft with respect to said head and being configured to abut an outer surface of said second section, said shaft being configured to extend below and abut a bottom surface of the handrail;

a lower shelf having a lower end, an upper end and a peripheral wall extending between said upper and lower ends, each of said lower end, said upper end and said peripheral wall defining an interior space of said lower shelf, said lower shelf being attached to and extending outwardly from said front surface of said panel, said lower end extending an equal distance away from said first and second lateral edges;

a plurality of openings positioned in said lower shelf, each of said openings providing access into said interior space of said lower shelf wherein each of said openings is configured to receive a tool therein;

an upper shelf being attached to and extending outwardly from said front surface of said panel, said upper shelf being positioned horizontally with respect to said panel, a bottom of said upper shelf being constructed from a mesh material, said upper shelf having a bottom and a perimeter wall, said perimeter wall being attached to and extending upwardly from said bottom, said perimeter wall including a pair of side walls and a front wall, said front wall of said upper shelf being attached to and extending between said side walls of said upper shelf, said bottom extending an equal distance away from said first and second lateral edges;

a front wall of said lower shelf extending outwardly from said front surface a greater distance than said front wall of said upper shelf extends outwardly from said front surface;

a plurality of couplers positioned proximately to said first lateral edge, extending vertically along said panel, said plurality of couplers for selectively engaging said panel and a surface of a scissor lift; and a plurality of couplers positioned proximately to said second lateral edge, extending vertically along said panel, said plurality of couplers for selectively engaging said panel and a surface of a scissor lift.

2. The assembly of claim 1, further comprising said first section being positioned transversely relative to said panel, said second section being positioned parallel with respect to said panel and being spaced from said back surface.

3. The assembly of claim 1, further comprising said lower shelf being positioned horizontally with respect to said panel.

4. The assembly of claim 1, further comprising said lower end of said lower shelf being constructed from a mesh material.

5. The assembly of claim 1, further comprising wherein said peripheral wall includes an uppermost edge, a lowermost edge, a pair of side walls and a front wall, said front wall of said lower shelf being coupled to and extending between said side walls of said lower shelf.

6. The assembly of claim 5, further comprising said front wall of said lower shelf slanting outwardly from said panel such that a distance between said uppermost edge and said front surface of said panel is greater than a distance between said lowermost edge and said front surface of said panel.

7. The assembly of claim 5, further comprising said uppermost edge extending above said upper end.

8. The assembly of claim 5, further comprising a bottom edge of said panel extending downwardly below said lower end of said lower shelf.

9. The assembly of claim 1, further comprising said openings extending into said upper end of said lower shelf.

10. A tool shelf assembly comprising:

a panel having a front surface, a back surface, a top edge, a bottom edge, a first lateral edge and a second lateral edge;

a flange coupled to said panel, said flange including a first section attached to a second section, said first section being coupled to and extending outwardly of said top edge away from said front surface, said second section extending downwardly from an outer edge of said first section, said first section being positioned transversely relative to said panel, said second section being positioned parallel with respect to said panel, said second section being spaced from said back surface wherein said flange and said back surface form a channel, said channel being configured to receive a handrail of a scissor lift to support said panel on the scissor lift;

an upper shelf being attached to and extending outwardly from said front surface of said panel, said upper shelf having a bottom and a perimeter wall, said perimeter wall being attached to and extending upwardly from said bottom, said perimeter wall including a pair of side walls and a front wall, said front wall of said upper shelf being attached to and extending between said side walls of said upper shelf, said bottom extending an equal distance away from said first and second lateral edges wherein said equal distance is not less than 1 inch, said upper shelf being positioned horizontally with respect to said panel, said bottom being constructed from a wired mesh material;

a lower shelf having a lower end, an upper end and a peripheral wall extending between said upper and lower end, said peripheral wall including an uppermost edge, a lowermost edge, a pair of side walls and a front wall, said front wall of said lower shelf being coupled to and extending between said side walls of said lower shelf, each of said lower end, said upper end and said peripheral wall defining an interior space of said lower shelf, said lower shelf being attached to and extending outwardly from said front surface of said panel, said lower end extending an equal distance away from said first and second lateral edges of said panel wherein said equal distance is not less than 1 inch, said lower shelf being positioned horizontally with respect to said panel, said lower end being constructed from a wired mesh material, said front wall of said lower shelf extending outwardly from said front surface a greater distance than said front wall of said upper shelf extends outwardly from said front surface, said front wall of said lower shelf slanting outwardly from said panel such that a distance between said uppermost edge and said front surface of said panel is greater than a distance between said lowermost edge and said front surface of said panel, said uppermost edge extending above said upper end, said bottom edge of said panel extending downwardly below said lower end of said lower shelf;

a plurality of openings positioned in said lower shelf, said openings extending into said upper end of said lower shelf, each of said openings providing access into said interior space of said lower shelf wherein each of said openings is configured to receive a tool therein, said openings including annular-shaped openings and rectangular-shaped openings;

a plurality of fasteners selectively engaging said flange and said panel wherein said plurality of fasteners are configured to releasably retain the handrail within said channel, said plurality of fasteners each including a nut and a bolt, said bolt having a head coupled to a shaft, said head being extendable through said panel wherein said head is configured to abut said front surface of said panel, said shaft being extendable through said second section of said flange, said nut being positionable on a distal end of said shaft with respect to said head and being configured to abut an outer surface of said second section, said shaft being configured to extend below and abut a bottom surface of the handrail;

a plurality of couplers positioned proximately to said first lateral edge, extending vertically along said panel, said plurality of couplers further for selectively engaging said panel and a surface of a scissor lift; and a plurality of couplers positioned proximately to said second lateral edge, extending vertically along said panel, said plurality of couplers further for selectively engaging said panel and a surface of a scissor lift.

* * * * *